US009383684B1

(12) United States Patent
Josiah et al.

(10) Patent No.: US 9,383,684 B1
(45) Date of Patent: Jul. 5, 2016

(54) METHOD AND SYSTEM FOR CONVERTING A TONER CARTRIDGE PRINTER TO A WHITE TONER PRINTER

(71) Applicant: UI Technologies, Inc., Las Vegas, NV (US)

(72) Inventors: Michael Raymond Josiah, North Patchogue, NY (US); Joseph Dovi, Lake Grove, NY (US)

(73) Assignee: UI Technologies, Inc., Las Vegas, NV (US)

( * ) Notice: Subject to any disclaimer, the term of this patent is extended or adjusted under 35 U.S.C. 154(b) by 0 days.

(21) Appl. No.: 14/731,785

(22) Filed: Jun. 5, 2015

(51) Int. Cl.
*G03G 15/08* (2006.01)

(52) U.S. Cl.
CPC .. *G03G 15/0894* (2013.01); *G03G 2215/00987* (2013.01)

(58) Field of Classification Search
CPC ..... G03G 15/0894; G03G 15/5079; G03G 15/55; G03G 15/556; G03G 15/0865; G03G 15/0867; G03G 21/10; G03G 21/181; G03G 2215/0875
USPC ..... 399/109
See application file for complete search history.

(56) References Cited

U.S. PATENT DOCUMENTS

| | | | | |
|---|---|---|---|---|
| 4,630,076 | A | 12/1986 | Yoshimura | |
| 4,943,506 | A | 7/1990 | Demizu et al. | |
| 5,223,906 | A | 6/1993 | Harris | |
| 5,367,327 | A | 11/1994 | Harris | |
| 6,114,077 | A | 9/2000 | Voets et al. | |
| 6,203,953 | B1 | 3/2001 | Dalal | |
| 6,249,655 | B1 * | 6/2001 | Baek | G03G 15/0121 222/DIG. 1 |
| 6,535,712 | B2 * | 3/2003 | Richards | G03G 13/08 399/341 |
| 6,640,843 | B2 | 11/2003 | Lee | |
| 6,769,766 | B2 | 8/2004 | Suzuki et al. | |
| 6,975,428 | B1 | 12/2005 | Ernst | |
| 7,061,503 | B2 | 6/2006 | Newman | |
| 7,134,749 | B2 | 11/2006 | Ben-Zur et al. | |
| 7,261,390 | B2 | 8/2007 | Nishino | |
| 7,717,532 | B2 | 5/2010 | Kroon et al. | |

(Continued)

FOREIGN PATENT DOCUMENTS

| | | |
|---|---|---|
| EP | 0280378 | 3/1995 |
| WO | 2014206673 | 12/2014 |

OTHER PUBLICATIONS

Robert-Bosch; Digital Transfer Media for Printers with White Toner; website;Oct. 29 2014; 8 pages; Forever GmbH Digital Transfer Applications Technology; Heddesheim, Germany; http://www.seri-deco.fi/files/FOREVER%20No-Cut_white%20toner%20flyer.pdf.

(Continued)

*Primary Examiner* — Walter L Lindsay, Jr.
*Assistant Examiner* — Jessica L Eley
(74) *Attorney, Agent, or Firm* — Hankin Patent Law, APC; Kevin Schraven; Jimmy Sauz

(57) ABSTRACT

Method and system for converting a toner cartridge printer to a white toner printer. The method may comprise the steps of: providing a printer having one or more toner cartridges; removing at least one of the one or more toner cartridges; disassembling the one or more removed toner cartridges; cleaning the one or more removed toner cartridges; filling the one or more removed toner cartridges with a white toner; and installing the one or more removed white toner cartridges into the printer.

15 Claims, 4 Drawing Sheets

(56) References Cited

U.S. PATENT DOCUMENTS

| | | | | |
|---|---|---|---|---|
| 8,205,981 | B1 | 6/2012 | Marino et al. | |
| 8,298,737 | B2 | 10/2012 | Kadokura | |
| 8,348,399 | B2 | 1/2013 | Gengrinovich | |
| 8,351,100 | B2 | 1/2013 | Mestha et al. | |
| 8,599,436 | B2 | 12/2013 | Sano et al. | |
| 8,728,696 | B2 | 5/2014 | Yamada | |
| 8,735,320 | B2 | 5/2014 | La Costa | |
| 8,784,508 | B2 | 7/2014 | Ellis | |
| 8,851,641 | B2 | 10/2014 | Kamiyama | |
| 2004/0252173 | A1 | 12/2004 | Ben-Zur et al. | |
| 2005/0264632 | A1 | 12/2005 | Glass et al. | |
| 2006/0034509 | A1 | 2/2006 | Lu et al. | |
| 2006/0162586 | A1 | 7/2006 | Fresener et al. | |
| 2008/0218539 | A1 | 9/2008 | Hill et al. | |
| 2009/0040249 | A1 | 2/2009 | Wouters | |
| 2012/0051816 | A1* | 3/2012 | Chiyoda | G03G 15/2064 399/341 |
| 2013/0113854 | A1 | 5/2013 | Iwata | |
| 2013/0235398 | A1 | 9/2013 | Bhatti et al. | |
| 2013/0308985 | A1 | 11/2013 | Kim | |
| 2013/0330522 | A1* | 12/2013 | Suzuki | G03G 9/0902 428/195.1 |
| 2014/0292855 | A1 | 10/2014 | Chang | |

OTHER PUBLICATIONS

Anthony Dinezza; Can a Printer Print White Color; website forum; Apr. 15, 2014; 3 pages; Super User; http://superuser.com/questions/663316/can-a-printer-print-white-color.

T-Shirt Forums; Okidata Laser with White Toner; website forum; Jan. 4, 2013; 7 pages; T-Shirt Forums; http://www.t-shirtforums.com/laser-heat-transfer-paper/t209046.html.

Top Useful Solutions; DIY White Toner Laser Printer; website forum; Mar. 20, 2015; 4 pages; Top Useful Solutions; http://topusefulsolutions.com/10813/diy-white-toner-laser-printer.

Heat Press Nation; White Toner; website; Apr. 2015; 5 pages; Brea, California; Heat Press Nation; http://www.heatpressnation.com/catalogsearch/result/?q=white+toner&x=0&y=0.

Inkfilling; White Toner; website forum; Apr. 2015; 2 pages; Irwindale, California; Inkfilling; https://www.inkfilling.com/inquiries/thread_1933.html.

Alibaba; White Toner; website; Feb. 9, 2016; 2 pages; China; Alibaba; http://sourcing.alibaba.com/rfq_search_list.htm?fsb=y&IndexArea=rfq_en&CatId=&SearchText=white+toner.

Superuser; What will happen if i put colored toner in Black white laser printer cartridge; website forum; Jan. 20, 2010; 2 pages; Superuser; http://superuser.com/questions/98147/what-will-happen-if-i-putcolored-toner-in-black-white-laser-printer-cartridge.

Superuser; Can I refill monochrome laser printer cartridge with color powder; website forum; Jan. 3, 2015; 2 pages; Superuser; http://superusercom/questions/860019/can-i-refill-monochrome-laserprinter-cartridge-with-color-powder.

Denis Cormier, et al.; Experiments in Layered Electro-Photographic Printing; manuscript; Apr. 2015; 7 pages; North Carolina State University; Raleigh, North Carolina; North Carolina State University; http://sffsymposium.engr.utexas.edu/Manuscripts/2000/2000-33-Cormier.pdf.

Graphics One; Oki pro920WT White Toner Solution; catalog; 2 pages; Graphics One; Apr. 2015; http://www.graphicsone.com/stage/media/catalog/product/PDFs/920%2OWT%20Quick%20FAQs.pdf.

Wikipedia; Toner refill; website; Apr. 29, 2015; 3 pages; Wikipedia; http://en.wikipedia.org/wiki/Toner_refill.

Uni-Kit; Toner Refill Instructions; manual; Apr. 2015; 142 pages; Easy Group; http://www.refillinstructions.com/tonerrefillinstructions.pdf.

Gctech; 4 pack toner refill kit; website; Nov. 12, 2008; 6 pages; Amazon; http://www.amazon.com/Refill-LaserJet-2605DTN-Cartridges-INCLUDES/dp/B001L1A1DS.

Florent Pellegrin; Refilling method for ink jet cartridges; manual; 2007; 252 pages; Thailand; Master Cartridges; http://www.refillinstructions.com/GeneralRefill.pdf.

Walmart; Ink Refill Kit; website; Apr. 2015; 4 pages; Walmart; http://www.walmart.com/c/ep/ink-refill-kit.

Alibaba; White Ink Refill; website; Apr. 2015; 8 pages; China; Alibaba; http://www.alibaba.com/showroom/white-ink-refill.html.

Print Country; Printer Ink Cartridges Refill Kit Troubleshooting; website; Lihua, Hawaii; Apr. 2015; 6 pages; Print Country; http://www.printcountry.com/faq-troubleshooting-refill-kits.asp.

Coldesi Colman; Viper DTG Printer Training Videos—Filling Machine With Ink; video; Mar. 7, 2013; Youtube; https://www.youtube.com/watch?v=sLyN8fCoy9Q.

Pantograms; Make More Money with our Stitch-n-Print Solutions Combining Embroidery With White Toner Laser Printers; website article; Tampa, Florida; Apr. 2015; 5 pages; Pantograms; http://www.pantograms.com/stitchnprintembroideryandheattransfers.asp.

Automatic Transfer, Inc.; White Sublimation Laser Toner; website; Alpha, New Jersey; Apr. 2015; 3 pages; Automatic Transfer, Inc.; http://www.atttransfer.com/whitetoner.html.

The Recycler; OKI's white toner technology wins awards; website article; Mar. 22, 2013; 2 pages; The Recycler; http://www.therecycler.com/posts/okis-white-toner-technology-winsawards/.

Print Planet; The 5th Toner; website forum; Apr. 6, 2012; 2 pages; Print Planet; http://printplanet.comlforums/digital-printing-discussion/28580-5thtoner.

* cited by examiner

METHOD AND SYSTEM FOR CONVERTING A TONER CARTRIDGE PRINTER TO A WHITE TONER PRINTER

FIELD OF USE

The present disclosure relates generally to printer cartridge refilling and refurbishment. More specifically, this disclosure relates methods and systems of converting a standard toner cartridge printer to a printer that prints with white toner.

BACKGROUND

Toner cartridge refurbishment and refilling is the practice of emptying, cleaning, and refilling laser printer toner cartridges with new toner powder. This enables the cartridge to be reused, thereby saving the cost of a complete new cartridge and saving the negative impact of the waste and disposal of the cartridge.

The refilling and/or refurbishment of toner cartridge may be done by an end user through the use of a toner refill kit, an original manufacturer, or a third party. When refilling and/or refurbishing a standard toner cartridge, the user refills and reuses the toner cartridge for a compatible printer. Current third party refilling and refurbishment services and products replace the toner with a similarly colored toner.

Traditional Cyan (C), Magenta (M), Yellow (Y), and Black (K) (or CMYK) Laser or Light Emitting Diode (LED) type printers come standard with Cyan, Magenta, Yellow and Black toner and/or drum cartridges. However, traditional black toner printers and CMYK toner printers are generally unable to print in white on colored media, as these printers lack white toner and/or drum cartridges. Printing in white toner is feasible through the use of white toner printers and would generally allow a user to print on dark or clear media, but white media toner printers are usually very expensive and may require the user to buy an entirely new printer.

Typical CMYK printers use all four colors but assume that the media used is white. Thus, any blank or empty area in an image is assumed to be white by the printer. This is usually appropriate for light or white media, but typically causes problems when darker media is used. For example, a picture of a person wearing a white shirt on white paper will appear white, but will be the color of the media when colored media is used.

Thus, there is a need for a system and method for converting or retrofitting a standard CMYK or black toner printer to print using white toner.

SUMMARY OF EMBODIMENTS

To minimize the limitations in the cited references, and to minimize other limitations that will become apparent upon reading and understanding the present specification, the toner printer converting, refilling, and refurbishment systems and methods disclosed herein preferably allow a user to convert a standard printer into one that prints using white toner.

In various embodiments, the methods and systems may be used to convert a traditional toner cartridge(s) and/or drum(s) printing machine to a printing machine that prints white from one or more of the toner cartridge(s). This allows the converted printing machine to print white in the event that the medium or substrate is a color other than white.

In general, the method may comprise the steps: disassembling, cleaning, replacing one or more colored/black toners with white toner, reassembling a toner cartridge(s) and/or drum(s) and then installing the cartridge(s) and/or drum(s) in the printing apparatus. Once the white toner is filled in the appropriate toner cartridge(s) and/or drum(s), the user may need to adjust the printer driver software settings based on the print job and/or the configuration of the printer. The printer controls are not adjusted or changed and no new printer driver software is needed. Generally, there may be four configurations for which the method may be used:

- Single White Cartridge—CMYK printer with separate toner and drum cartridges—white for K swap
  - Print black through composite CMY printing
  - Print white through 100% K
- Double White Printing—CMYK printer with separate toner and drum cartridges—white for magenta and yellow swap
  - Turn off cyan
  - Print white through red (½ yellow and ½ magenta), which preferably results in double white printing.
- Double White Printing—CMYK printer with a single drum and separate toner cartridges—white for magenta and yellow swap
  - Turn off cyan
  - Print white through red (½ yellow and ½ magenta), which preferably results in double white printing.
- Single White Cartridge—black only machine with separate or combined toner and drum cartridge
  - Prints only in white One embodiment of the method of converting a printer to print with white toner may comprise the steps: providing a printer; wherein the printer has one or more printing cartridges; removing at least one of the one or more printing cartridges; disassembling the one or more removed printing cartridges; emptying and cleaning the one or more removed printing cartridges; filling the one or more removed printing cartridges with a white toner; and installing the one or more removed white toner filled cartridges into the printer. The printer may be a color printer. The printer may be a CYMK color printer. The printer may be a monochromatic printer. The printer may be a laser or LED. The printer may comprise separate drum and toner cartridges. The one or more printing cartridges may comprise a single drum cartridge and one or more color toner cartridges. The one or more color toner cartridges may comprise a cyan cartridge, a yellow cartridge, a magenta cartridge, and a black cartridge. The one or more printing cartridges may comprise a cyan cartridge, a yellow cartridge, a magenta cartridge, and a black cartridge. The one or more removed printing cartridge may be a black toner cartridge. The one or more removed printing cartridges may be a yellow toner cartridge and a magenta toner cartridge. The method may further comprise the step: adjusting one or more printer driver software settings so that the printer prints using the one or more white toner filled cartridges.

Another embodiment of the method of converting a printer to print with white toner may comprise the steps: providing a color toner printer; wherein the color toner printer may comprise a plurality of drum cartridges and a plurality of toner cartridges; wherein the plurality of toner cartridges may comprise a cyan toner cartridge, a yellow toner cartridge, a magenta toner cartridge, and a black toner cartridge; wherein the plurality of drum cartridges may comprise a cyan drum cartridge, a yellow drum cartridge, a magenta drum cartridge, and a black drum cartridge; removing the black toner cartridge and the black drum cartridge; disassembling the black drum cartridge; emptying and cleaning the black toner cartridge and the black drum cartridge; priming the black drum cartridge with a white toner; filling the black toner cartridge with the white toner; and installing the white toner filled cartridge and the white toner primed drum into the printer.

The method may further comprise the steps of: refurbishing at least one of the black toner cartridge and the black drum cartridge and/or disassembling the black toner cartridge. The method may further comprise the step: adjusting one or more printer driver software settings so that the printer prints using the white toner filled cartridge.

Another embodiment of the method of converting a printer to print with white toner may comprise the steps: providing a color toner printer; wherein the color toner printer may comprise a plurality of drum cartridges and a plurality of toner cartridges; wherein the plurality of toner cartridges may comprise a cyan toner cartridge, a yellow toner cartridge, a magenta toner cartridge, and a black toner cartridge; wherein the plurality of drum cartridges may comprise a cyan drum cartridge, a yellow drum cartridge, a magenta drum cartridge, and a black drum cartridge; removing the yellow toner cartridge, the magenta toner cartridge, the yellow drum cartridge, and the magenta drum cartridge; disassembling the yellow drum cartridge and the magenta drum cartridge; emptying and cleaning the yellow toner cartridge, the magenta toner cartridge, the yellow drum cartridge, and the magenta drum cartridge; priming the yellow drum cartridge and the magenta drum cartridge with a white toner; filling the yellow toner cartridge and the magenta toner cartridge with the white toner; and installing the white toner filled cartridges and the white toner primed drums into the printer. The method may further comprise the step of: refurbishing at least one of the yellow toner cartridge, the magenta toner cartridge, the yellow drum cartridge, and the magenta drum cartridge and/or disassembling at least one of the yellow toner cartridge and the magenta toner cartridge. The method may further comprise the step: adjusting one or more printer driver software settings so that the printer prints using the white toner filled cartridges.

Another embodiment of the method of converting a printer to print with white toner may comprise the steps: providing a color toner printer; wherein the color toner printer may comprise a drum cartridge and a plurality of toner cartridges; wherein the plurality of toner cartridges may comprise a cyan toner cartridge, a yellow toner cartridge, a magenta toner cartridge, and a black toner cartridge; removing the yellow toner cartridge, the magenta toner cartridge, and the drum cartridge; disassembling the drum cartridge; emptying and cleaning the yellow toner cartridge, the magenta toner cartridge, and the drum cartridge; priming the drum cartridge with a white toner; filling the yellow toner cartridge and the magenta toner cartridge with the white toner; and installing the white toner filled cartridges and the white toner primed drum into the printer. The method may further comprise the steps of: refurbishing at least one of the yellow toner cartridge, the magenta toner cartridge, and the drum cartridge and/or disassembling at least one of the yellow toner cartridge and the magenta toner cartridge. The method may further comprise the step: adjusting one or more printer driver software settings so that the printer prints using the white toner filled cartridges.

Another embodiment of the method of converting a printer to print with white toner may comprise the steps: providing a monochromatic printer; wherein the monochromatic printer has one or more printing cartridges; removing at least one of the one or more printing cartridges; disassembling the one or more removed printing cartridges; emptying and cleaning the one or more removed printing cartridges; filling the one or more removed printing cartridges with a white toner; and installing the one or more removed white toner filled cartridges into the printer. The method may further comprising the step of: refurbishing at least one of the one or more removed printing cartridges. The one or more printing cartridges may comprise a toner cartridge and a drum cartridge. The one or more printing cartridges may comprise a combined toner and drum cartridge. The method may further comprise the step: adjusting one or more printer driver software settings so that the printer prints using the one or more white toner filled cartridges.

Preferably, the method and system for converting a toner cartridge printer to a white toner requires no special or dedicated printer drivers.

Preferably, the method and system for converting a toner cartridge printer to a white toner printer may comprise emptying, cleaning, and refurbishing a new or used toner cartridge and/or drum (if separate) so that all of the worn parts may be replaced. Used toner cartridges will have toner everywhere, so a thorough cleaning is very important.

It is an object of the present system and method for converting a standard toner cartridge printer into white toner printer to overcome the limitations of the prior art.

Other features and advantages inherent in the system and method for converting a standard toner cartridge printer into white toner printer claimed and disclosed will become apparent to those skilled in the art from the following detailed description and its accompanying drawings.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps which are illustrated. When the same numeral appears in different drawings, it refers to the same or like components or steps.

DETAILED DESCRIPTION OF THE ILLUSTRATIVE EMBODIMENTS

Figure 1:
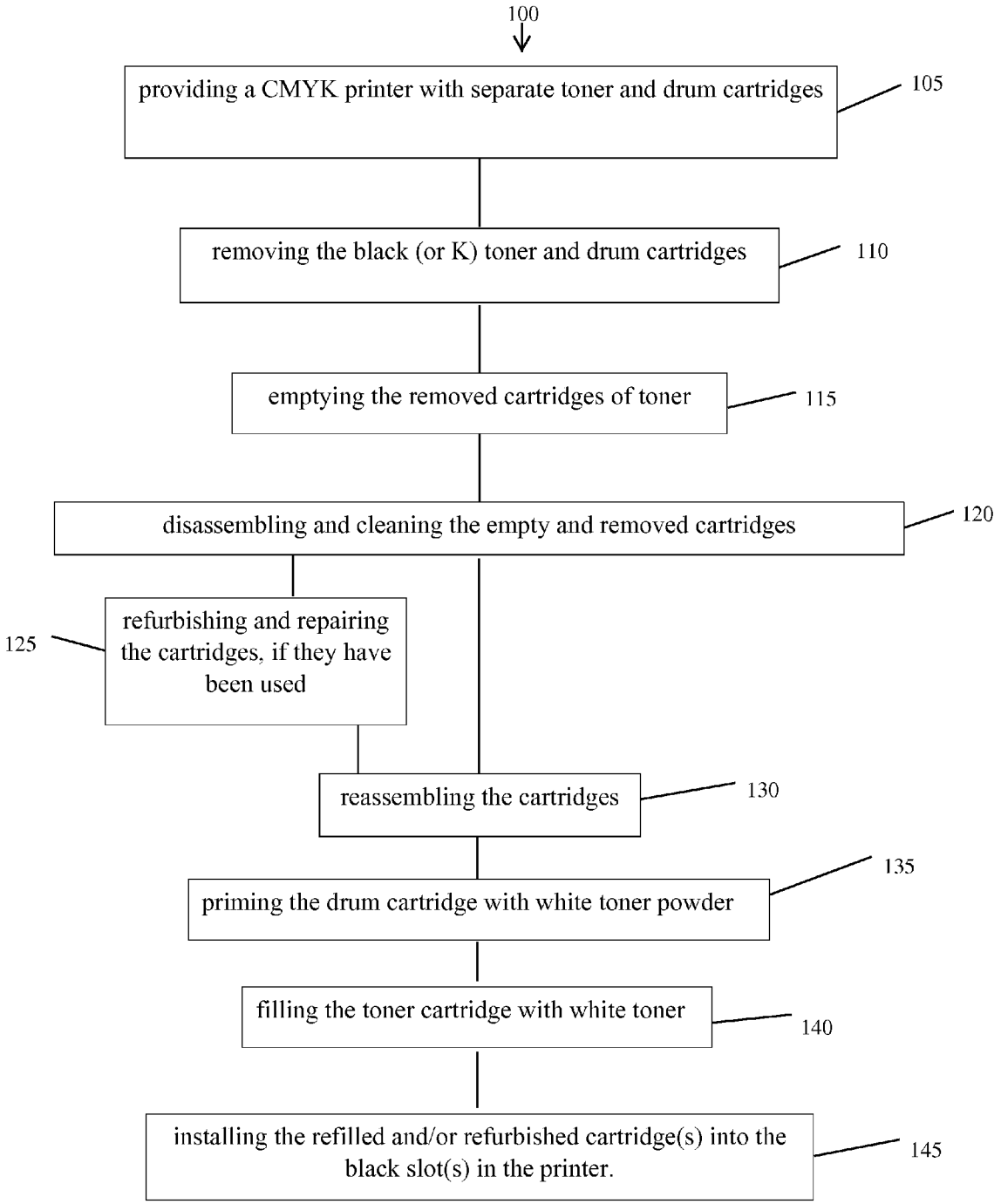
FIG. 1 is a flow block diagram of one embodiment of the method of converting a printer to print with white toner with a single cartridge conversion.

In the following detailed description, numerous specific details are set forth in order to provide a thorough understanding of various aspects of one or more embodiments. However, the one or more embodiments may be practiced without some or all of these specific details. In other instances, well-known methods, procedures, and/or components have not been described in detail so as not to unnecessarily obscure aspects of embodiments.

While multiple embodiments are disclosed, still other embodiments will become apparent to those skilled in the art from the following detailed description. As will be realized, these embodiments are capable of modifications in various obvious aspects, all without departing from the spirit and scope of protection. Accordingly, the screen shots, figures, and the detailed descriptions thereof, are to be regarded as illustrative in nature and not restrictive. Also, the reference or non-reference to a particular embodiment of the invention shall not be interpreted to limit the scope of protection.

The present specification discloses a system and method for converting for converting a toner cartridge printer to a white toner. Preferably, the system and method for converting a toner cartridge printer converts a cartridge that has never been used before. In this manner, less cleaning is needed as a used cartridge has toner everywhere. However, the method will work with used cartridges, but carefully cleaning should be employed. The method and system for converting a toner cartridge printer to a white toner preferably requires no special or dedicated printer drivers.

In the following description, certain terminology is used to describe certain features of one or more embodiments. For purposes of the specification, unless otherwise specified, the term "printing cartridges" generally refers to a toner cartridge, a laser toner cartridge, a drum cartridge, and/or a toner and drum combined cartridge.

As used herein, the term "toner" generally refers to a powder, particulate, or dry ink that is used in laser printers, printers, and printing machines to form the printed text and images on the medium being printed. Generally, toner particles are melted by the heat of a fuser, and bound to the media. As used herein, the terms "refurbishment", "repair", and "remanufacturing" generally refer to replacing any defective or worn parts in a printing cartridge.

The present method and system for converting a toner cartridge printer to a white toner printer may allow the conversion of: (1) a single conversion of a CMYK machine that has separate toner and drum cartridges; (2) a double conversion of a CMYK machine that has separate toner and drum cartridges; (3) a double conversion of a CMYK Machine with a single drum and separate toner cartridges; and (4) a monochromatic machine with a separate or combined toner and drum cartridges.

Regarding the conversion of a CMYK machine that has separate toner and drum cartridges, the conversion may comprise a single white toner cartridge conversion or a double white cartridge conversion.

The single printer cartridge conversion may comprise the steps: providing a CMYK printer with separate toner and drum cartridges; removing the black (or K) toner and drum cartridge(s); emptying the cartridges of toner; disassembling and cleaning the cartridges; (if used and necessary); refurbishing and repairing the cartridges; reassembling the cartridges; (if separate); priming the drum cartridge with white toner powder; filling the toner cartridge with white toner; and installing the refilled and/or refurbished cartridges into the black slots of the printer.

In order to print white, the user must preferably set the printer driver software settings to print using 100% K, rather than the 60 to 100% blend of C, M and Y (composite CMY black). For a full color image including black, this method may be performed by setting the parts of the printed image desired to be in white as 100% K and those parts desired to be in black composite CMY black. The converted printer may be a five (5) color system: White, Cyan, Magenta, Yellow and composite black. This method may also be used to create spot color white cartridges. If the print job has an image where white toner is needed but not yellow, the yellow toner and drum units may be cleaned and filled with white toner. In this case, now anything printed with pure 100% yellow will be white. No other parts of the image can be made of colors that use yellow for this version, however. Thus, this alternative may be used for spot color printing only. This alteration may also be used for the Cyan and Magenta cartridges with the same use and limitations. In all these alternatives, the printer may be converted back by removing the white toner and drum cartridges and replacing them with a traditional black (or color if using spot colors) set. The printer controls are not adjusted and no additional or new printer drivers are needed.

FIG. 1 is a flow block diagram of one embodiment of the method of converting a printer to print with white toner. FIG. 1 shows that the single printer cartridge conversion method 100 may comprise the steps: 105, 110, 115, 120, 125, 130, 135, 140, and 145. Step 105 may be providing a CMYK printer with separate toner and drum cartridges. The method 100 may also be used with a CMYK printer, wherein each toner cartridge has a built in drum. The next step 110 may be removing the black (or K) toner and/or drum cartridges from the printer. The removed cartridges may then be emptied 115 of toner. The next step 120 may be disassembling and cleaning the cartridges. If the drum and/or toner cartridges are used or worn, they may be refurbished and/or repaired 125. Step 130 may be reassembling the cartridges. If the drum cartridges are separate, they may be primed with white toner powder 135. Step 140 may be filling the toner cartridge with white toner. Step 145 may be installing the cleaned, refurbished, refilled, and primed toner and cartridges into the black (K) slot(s) in the printer.

The double printing cartridges conversion may be desirable when more than one single pass of white may be needed to get optimum coverage. This is especially true for textured media. Additionally, for clear media, it may be desirable to be able to print in pure black using black toner in the K cartridge. The double printing cartridges conversion may comprise the steps: providing a CMYK printer with separate toner and drum cartridges; removing the yellow and magenta drum and toner cartridges; emptying the cartridges of toner; disassembling and cleaning the cartridges (if used and necessary); refurbishing and repairing the cartridges; reassembling the cartridges (if separate); priming the drum cartridges with white toner powder; filling both toner cartridges with white toner; and installing the refilled and/or refurbished cartridges into the yellow and magenta slots of the printer. White may be printed by setting the text or picture color to magenta or yellow on the printer driver software. Since one of the purposes of the double cartridge conversion may be to provide double white toner coverage for textured or clear media, the user may select a color that uses equal parts magenta and yellow. Red, specifically Red 204, is an example of where anything printed will have a pass of white from the former magenta cartridge and a pass from the former yellow cartridge. The black and cyan cartridges may have been left intact, which generally means that the image may print in black, cyan, white, and double white. The preferred color printer driver software setting for the brightest whites may be as follows:

Hexidecimal: #CC0000
RGB: R: 204 G: 0 B: 0
CMYK: C: 0%, M: 100% Y: 100% K: 0%
Pantone: 186 C Regarding an LED printer, an extra step may be performed to block the cyan from printing, so that what remains may be to have a true black and double white printer without any possibility of any color (cyan) printing. By placing a cover over the LED slot of the drum unit of the cyan, this will preferably effectively block the cyan from printing and will not generate a printer error. Some cyan toner may need to be in the drum unit for lubrication, but this lubrication amount is preferably not enough to be used for or effect the printing.

If converting a laser printer, the cyan laser slot of the drum unit may not be blocked as the printer will likely produce an error message and will not print. Because cyan color toner may be in the drum, care should be taken to avoid the cyan bleeding into the image.

Aside from printing in white, the modified printer may also print in black when black printing is set to pure 100% K. The printer can be brought back to standard CMYK printing by installing traditional magenta and yellow cartridge sets, and, if necessary, removing the LED blocking bar for the cyan on LED machines. Various embodiments of the retrofitted printer may be a CMYKB printer, wherein the B is black and K is a toner other than basic black.

Figure 2:
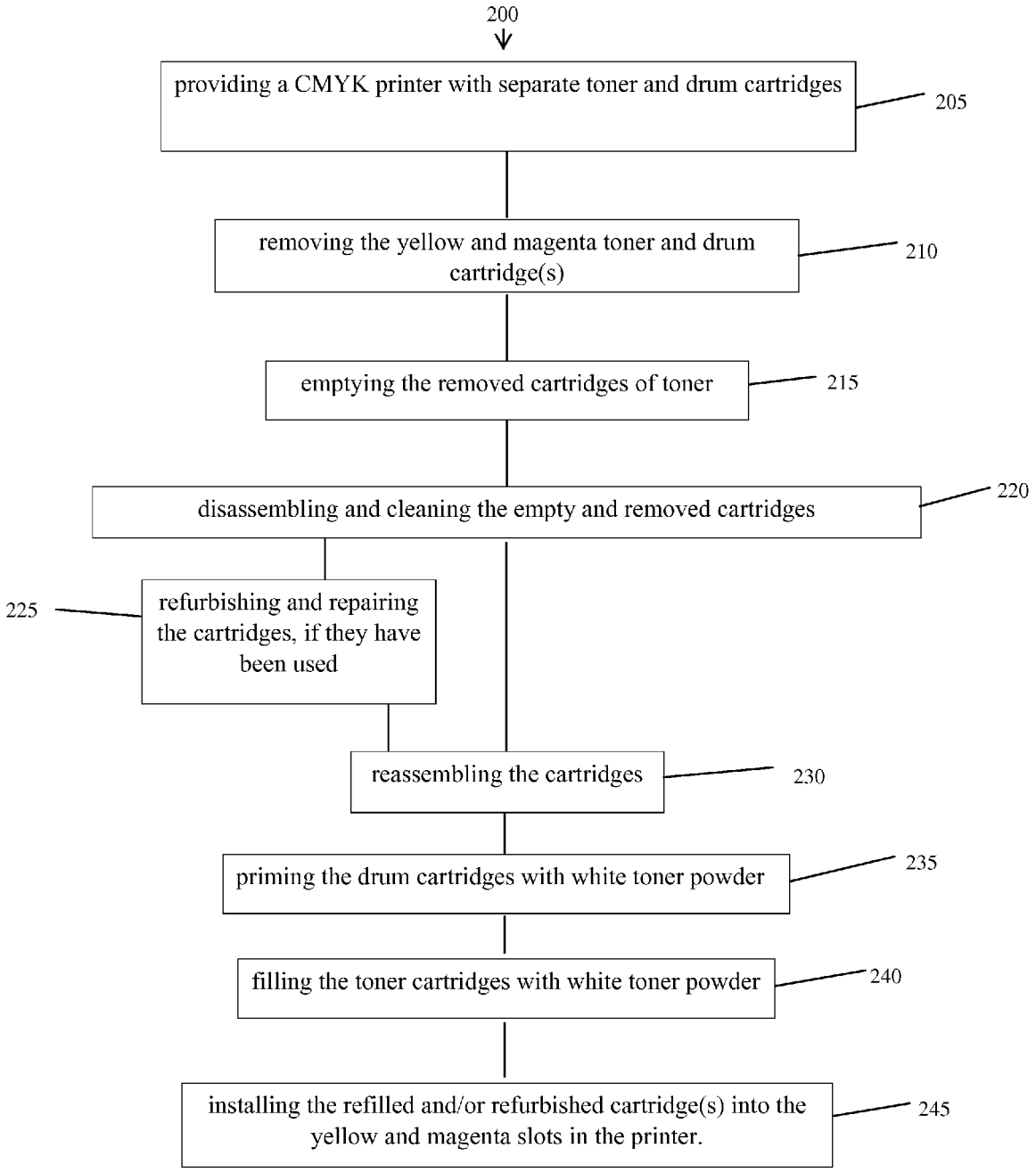
FIG. 2 is a flow block diagram of one embodiment of the method of converting a printer to print with white toner with a double cartridge conversion

FIG. 2 is a flow block diagram of another embodiment of the method of converting a printer to print with white toner and shows a double cartridge conversion of a CMYK printer. As shown in FIG. 2, the conversion method 200 may be a double printing cartridges conversion and may comprise the steps: providing a CMYK printer with separate toner and drum cartridges 205; removing the yellow and magenta drum and toner cartridges 210; emptying the cartridges of toner 215; disassembling and cleaning the empty and removed cartridges 220; refurbishing and repairing the cartridges 225 if used and if necessary; reassembling the cartridge 230; priming the drum cartridges with white toner powder 235; filling both toner cartridges with white toner 240; and installing the refilled and/or refurbished cartridges into the yellow and magenta slots in the printer 245.

In another embodiment, the method may be a double white printing conversion of a CMYK machine that has a single drum that operates with four or more separate toner cartridges. In this embodiment, the double printing cartridges conversion may comprise the steps: providing a CMYK printer with separate toner cartridges and a single drum cartridge; removing, disassembling, and cleaning the drum cartridge (note: care should be taken to thoroughly clean the yellow and magenta portion of the drum cartridge, because these portions will be switched to white toner); reassembling the drum unit; priming the magenta and yellow sections of the drum with white toner and prime the black and cyan sections with their respective colors (note: care should be taken not spill or mix toner as any amount will stain the white toner); removing and thoroughly cleaning the magenta and yellow toner cartridges; filling the magenta and yellow toner cartridges with white toner; and installing the toner cartridge back into the printer. Because the drum unit preferably contains all four color sections, it may be preferably to keep this embodiment of modified printer as a true black and double white printing machine. A blocking plate may be installed over the LED slot of the cyan drum section, so that no cyan can be printed. Some cyan toner is preferably left in the toner cartridge for drum lubrication but this may not be enough to print in cyan. White may be printed by setting the text or picture color to magenta or yellow on the printer driver software. Because one of the purposes of the double cartridge conversion may be to provide double white toner coverage for textured or clear media, the user may select a color that uses equal parts magenta and yellow. When converting a laser printer, the cyan laser slot of the drum unit is generally not blocked as the printer may produce an error message and will be unable to print at all. In this case, great care must be taken to remove any cyan colors from the image before printing.

Because both the magenta and yellow toner cartridges are now white, a color equal in both magenta and yellow may be used to get two printing passes of white toner. Red 204 or these specific colors are preferable for the brightest whites:

Hexidecimal: #CC0000

RGB: R: 204 G: 0 B: 0

CMYK C: 0%, M: 100% Y: 100% K: 0%

Pantone 186 C

Once converted, this embodiment of the printers is preferably left as dedicated black and double white machines, rather than converting the machine back to full color printing. Although not preferred, either the magenta or yellow may be converted, to create a single white printing machine.

Figure 3:
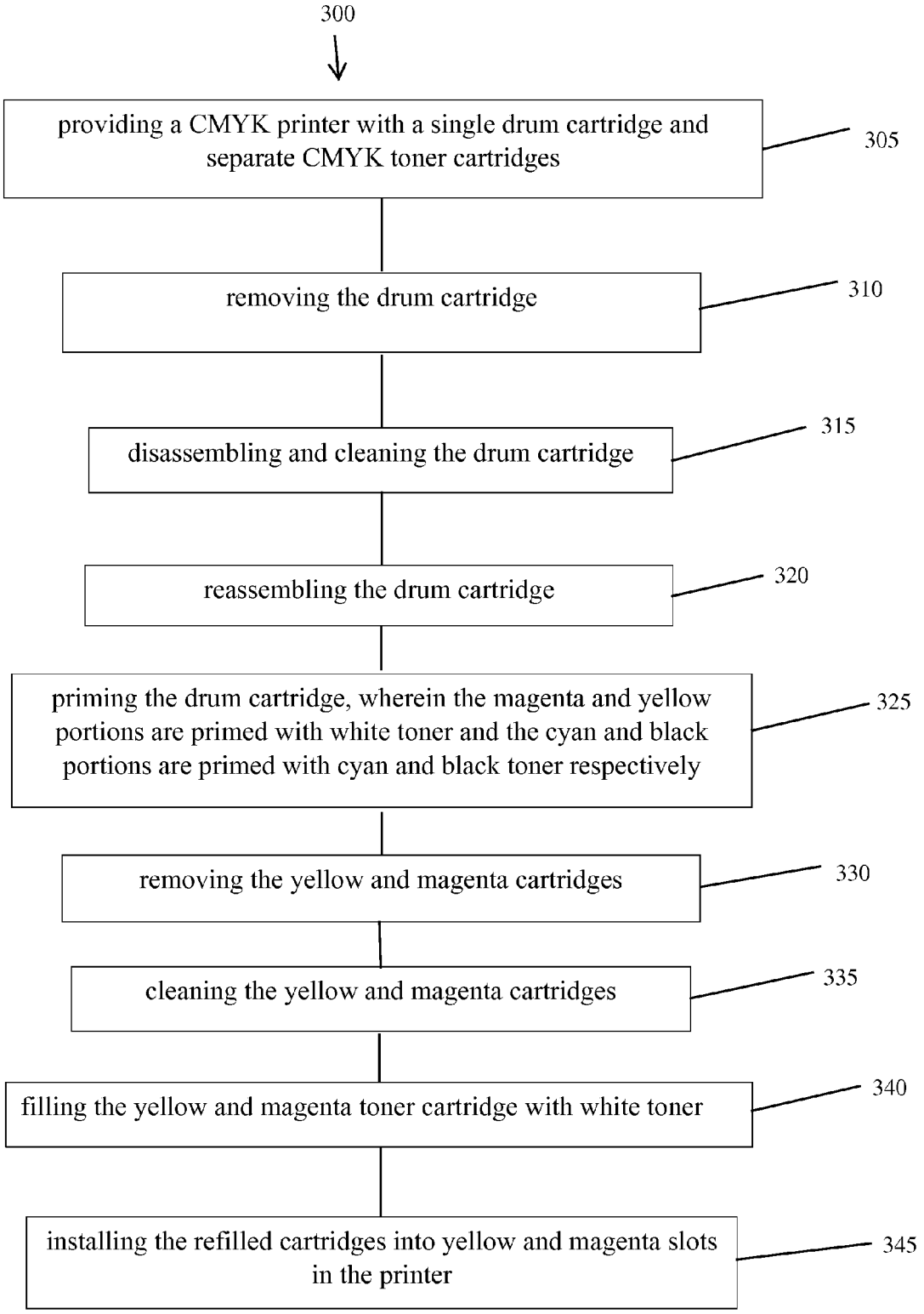
FIG. 3 is a flow block diagram of another embodiment of the method of converting a printer to print with white toner with a double cartridge conversion

FIG. 3 is a flow block diagram of another embodiment of the method of converting a printer to print with white toner. As shown in FIG. 3, this embodiment of the method 300 may be a double white printing conversion of a CMYK printer that has a single drum that operates with four or more separate toner cartridges and may comprise the steps: providing a CMYK printer with separate toner cartridges and a single drum cartridge 305; removing the drum cartridge 310; disassembling and/or cleaning the drum cartridge 315; reassembling the drum cartridge 320; priming the magenta and yellow sections of the drum with white toner and priming the black and cyan sections with their respective colors 325; removing the magenta and yellow toner cartridges 330; thoroughly cleaning the yellow and magenta cartridges 335; filling the magenta and yellow toner cartridges with white toner 340; and installing the toner cartridge back into the printer 345.

In another embodiment, a black only, or otherwise, monochromatic printer may be converted to print white. The retrofitted monochromatic printer may have either a separate toner and drum unit or a combined toner and drum cartridge. Regarding printers with separate toner and drum cartridges, both separate cartridges may be removed, disassembled, thoroughly cleaned, and both filled with white toner. Machines with combined cartridges may be removed, disassembled, cleaned, and/or filled with white toner. Preferably, the white image printed is set to print in pure black or K. The monochromatic white printer may be switched back to black by simply changes the cartridge(s) back to black.

Figure 4:
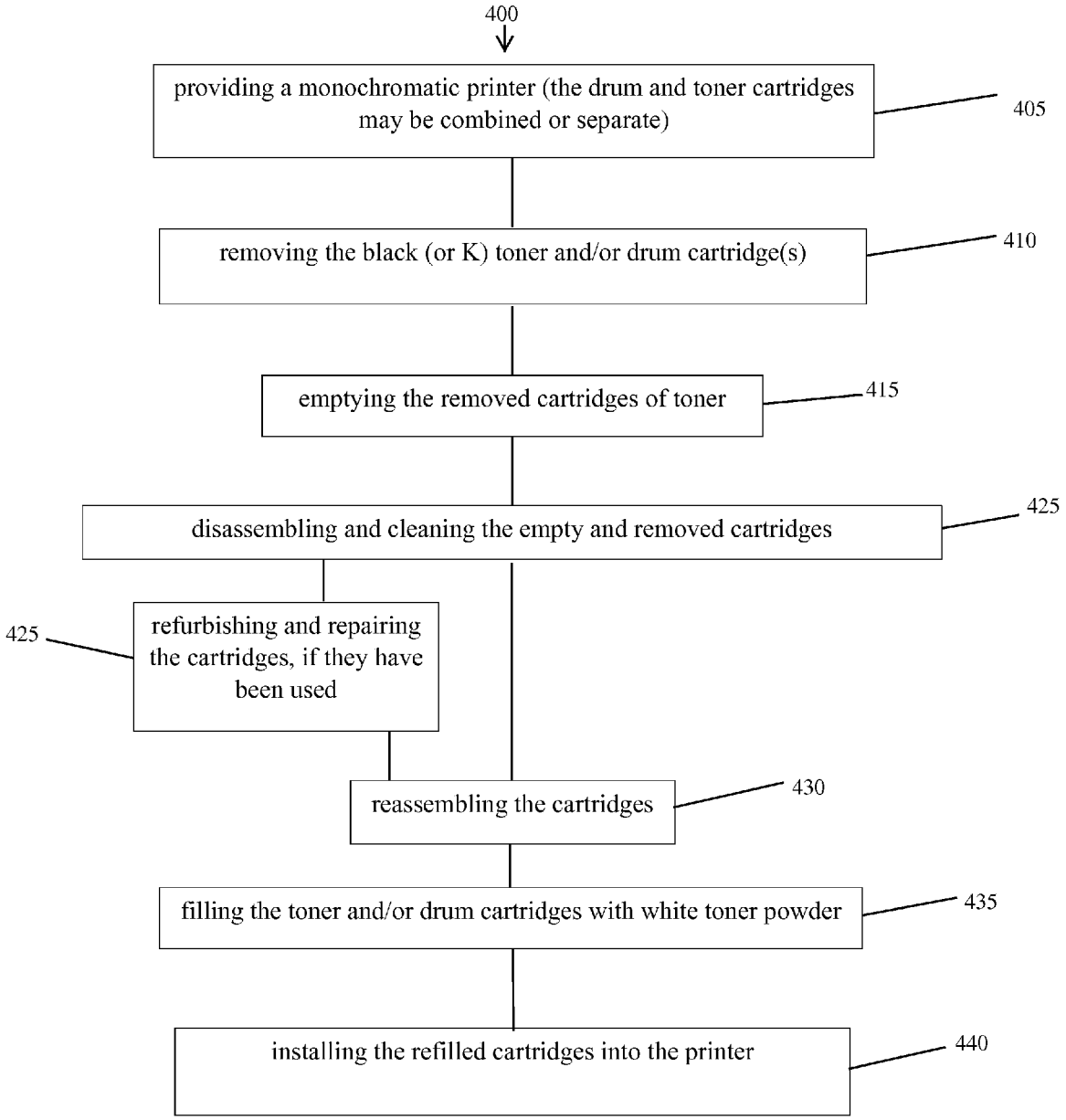
FIG. 4 is a flow block diagram of another embodiment of the method of converting a monochromatic printer to print with white toner.

FIG. 4 is a flow block diagram of another embodiment of the method of converting a printer to print with white toner. As shown in FIG. 4, the method 400 may comprise: providing a monochromatic printer (the drum and toner cartridges may be combined or separate) 405; removing the black (or K) toner and/or drum cartridge(s) 410; emptying the removed cartridges of toner 415; disassembling and cleaning the empty and removed cartridges 420; refurbishing and repairing the cartridges, if they have been used 425; reassembling the cartridges 430; filling the toner and/or drum cartridges with white toner powder 435, and installing the toner cartridge back into the printer 440.

Unless otherwise stated, all measurements, values, ratings, positions, magnitudes, sizes, locations, and other specifications, which set forth in this specification, including in the claims that follow, are approximate, not exact. They are intended to have a reasonable range, which is consistent with the functions to which they relate and with what is customary in the art to which they pertain.

The foregoing description of the preferred embodiment has been presented for the purposes of illustration and description. While multiple embodiments are disclosed, still other embodiments will become apparent to those skilled in the art from the above detailed description, which shows and describes the illustrative embodiments. As will be realized, these embodiments are capable of modifications in various obvious aspects, all without departing from the spirit and scope of the present disclosure. Accordingly, the detailed description is to be regarded as illustrative in nature and not restrictive. Also, although not explicitly recited, one or more additional embodiments may be practiced in combination or conjunction with one another. Furthermore, the reference or non-reference to a particular embodiment shall not be interpreted to limit the scope of protection. It is intended that the scope of protection not be limited by this detailed description, but by the claims and the equivalents to the claims that are appended hereto.

Except as stated immediately above, nothing which has been stated or illustrated is intended or should be interpreted to cause a dedication of any component, step, feature, object, benefit, advantage, or equivalent to the public, regardless of whether it is or is not recited in the claims.

What is claimed is:

1. A method of converting a printer to print with white toner, comprising the steps of:

providing a color toner printer;

wherein said color toner printer comprises a plurality of drum cartridges and a plurality of toner cartridges;

wherein said plurality of toner cartridges comprises a cyan toner cartridge, a yellow toner cartridge, a magenta toner cartridge, and a black toner cartridge;

wherein said plurality of drum cartridges comprises a cyan drum cartridge, a yellow drum cartridge, a magenta drum cartridge, and a black drum cartridge;

removing said black toner cartridge and said black drum cartridge;

disassembling said black drum cartridge;

emptying and cleaning said black toner cartridge and said black drum cartridge;

priming said black drum cartridge with a while toner;

filling said black toner cartridge with said white toner; and installing said white toner filled cartridge and said white toner primed drum into said printer.

2. The method of converting a printer to print with white toner of claim 1, further comprising the step:

refurbishing at least one of said black toner cartridge and said black drum cartridge.

3. The method of converting a printer to print with white toner of claim 1, further comprising the step:

disassembling said black toner cartridge.

4. The method of converting a printer to print with white toner of claim 1, further comprising the step:

adjusting one or more printer driver software settings so that said printer prints using said white toner filled cartridge.

5. The method of converting a printer to print with white toner of claim 4, wherein said one or more printer driver software settings is set to print at 100% K.

6. A method of converting a printer to print with white toner comprises the steps:

providing a color toner printer;

wherein said color toner printer comprises a plurality of drum cartridges and a plurality of toner cartridges;

wherein said plurality of toner cartridges comprises a cyan toner cartridge, a yellow toner cartridge, a magenta toner cartridge, and a black toner cartridge;

wherein said plurality of drum cartridges comprises a cyan drum cartridge, a yellow drum cartridge, a magenta drum cartridge, and a black drum cartridge;

removing said yellow toner cartridge, said magenta toner cartridge, said yellow drum cartridge, and said magenta drum cartridge;

disassembling said yellow drum cartridge and said magenta drum cartridge;

emptying and cleaning said yellow toner cartridge, said magenta toner cartridge, said yellow drum cartridge, and said magenta drum cartridge;

priming said yellow drum cartridge and said magenta drum cartridge with a white toner;

filling said yellow toner cartridge and said magenta toner cartridge with said white toner; and installing said white toner filled cartridge and said white toner primed drums into said printer.

7. The method of converting a printer to print with white toner of claim 6, further comprising the step:

refurbishing at least one of said yellow toner cartridge, said magenta toner cartridge, said yellow drum cartridge, and said magenta drum cartridge.

8. The method of converting a printer to print with white toner of claim 6, further comprising the step:

disassembling at least one of said yellow toner cartridge and said magenta toner cartridge.

9. The method of converting a printer to print with white toner of claim 6, further comprising the step:

adjusting one or more printer driver software settings so that said printer prints using said white toner filled cartridges.

10. The method of converting a printer to print with white toner of claim 9, wherein said one or more printer driver software settings is set to print Red 204 in order to print areas.

11. A method of converting a printer to print with white toner, comprising the steps of:

providing a color toner printer;

wherein said color toner printer comprises a drum cartridge and a plurality of toner cartridges;

wherein said plurality of toner cartridges comprises a cyan toner cartridge, a yellow toner cartridge, a magenta toner cartridge, and a black toner cartridge;

removing said yellow toner cartridge, said magenta toner cartridge, and said drum cartridge;

disassembling said drum cartridge;

emptying and cleaning said yellow toner cartridge, said magenta toner cartridge, and said drum cartridge;

priming said drum cartridge with a white toner;

filling said yellow toner cartridge and said magenta toner cartridge with said white toner; and installing said white toner filled cartridge and said white toner primed drum into said printer.

12. The method of converting a printer to print with white toner of claim 11, further comprising the step:

refurbishing at least one of said yellow toner cartridge, said magenta toner cartridge, and said drum cartridge.

13. The method of converting a printer to print with white toner of claim 11, further comprising the step:

disassembling at least one of said yellow toner cartridge and said magenta toner cartridge.

14. The method of converting a printer to print with white toner of claim 11, further comprising the step:

adjusting one or more printer driver software settings so that said printer prints using said white toner filled cartridges.

15. The method of converting a printer to print with white toner of claim 14, wherein said one or more printer driver software settings is set to printer Red 204 in order to white areas.

* * * * *